US006772442B2

(12) United States Patent
Erker

(10) Patent No.: US 6,772,442 B2
(45) Date of Patent: Aug. 10, 2004

(54) GOLF GLOVE

(76) Inventor: Hartmut Erker, Cuxhavener Strasse 106c, D-90425 Nurnberg (DE)

( * ) Notice: Subject to any disclaimer, the term of this patent is extended or adjusted under 35 U.S.C. 154(b) by 0 days.

(21) Appl. No.: 10/132,396

(22) Filed: Apr. 26, 2002

(65) Prior Publication Data

US 2002/0129437 A1 Sep. 19, 2002

Related U.S. Application Data

(63) Continuation-in-part of application No. 09/589,811, filed on Jun. 9, 2000, now abandoned.

(30) Foreign Application Priority Data

Jun. 10, 1999 (DE) ..... 199 26 458
Jan. 20, 2000 (DE) ..... 100 02 427
May 16, 2000 (DE) ..... 100 23 683

(51) Int. Cl.[7] ..... A41D 19/00
(52) U.S. Cl. ..... 2/161.2; 473/205
(58) Field of Search ..... 2/161.1, 161.2, 2/161.4, 163; 473/205, 206

(56) References Cited

U.S. PATENT DOCUMENTS 2,456,678 A * 12/1948 Cole ..... 2/159
3,501,773 A 3/1970 Stansberry et al.
3,762,719 A 10/1973 Smith
4,329,741 A 5/1982 Bach
4,488,726 A * 12/1984 Murray ..... 473/202
5,184,353 A 2/1993 Goldwitz
5,253,367 A 10/1993 Lappley
5,471,682 A 12/1995 Robins et al.
5,634,214 A 6/1997 St. Ville
5,681,993 A 10/1997 Heitman
5,733,201 A * 3/1998 Caldwell et al. ..... 473/202
5,771,492 A * 6/1998 Cozza ..... 2/161.2
6,033,370 A * 3/2000 Reinbold et al. ..... 600/595
6,162,185 A 12/2000 Amano et al.
6,401,254 B1 * 6/2002 Boller ..... 2/161.2

FOREIGN PATENT DOCUMENTS

JP 07289676 A 11/1995
JP 408173586 A 7/1996

* cited by examiner

*Primary Examiner*—Katherine Moran
(74) *Attorney, Agent, or Firm*—Hoffman, Wasson & Gitler, P.C.

(57) ABSTRACT

The invention relates to a novel golf glove and is characterized in that on the inside surface of the thumb of the glove, i.e. the surface that bears against the club shaft when playing, there is a pressure sensor that interacts with an acoustic signal transmitter or is part of an acoustic signal transmitter that delivers an acoustic signal when a predetermined trigger force acting on the sensor is exceeded.

11 Claims, 6 Drawing Sheets

GOLF GLOVE

This application is a continuation-in-part of Ser. No. 09/589,811 filed Jun. 9, 2000, now abandoned.

BACKGROUND OF THE INVENTION

Various versions of golf gloves are known. In particular, especially golf gloves are known with bulge-like position aids that are provided on the inside surface of the glove and that have at least one bulge-like projection for positioning of the club shaft on the hand, which then forms the contact surface for the shaft of the golf club (U.S. Pat. No. 5,253,367).

Providing a golf glove with sensors in the form of switches (U.S. Pat. No. 5,771,492) consisting of electronic circuitry to produce an acoustic signal when these sensors are actuated is furthermore known.

The object of the invention is to devise an improved version of a golf glove.

SUMMARY OF THE INVENTION

In the embodiment as claimed in the invention the glove for the hand that bears directly against the shaft of the club when hitting the ball with the club has a pressure sensor on the free end of the thumb that forces the signal transmitter, for example the electronic circuitry, to deliver a preferably acoustic signal when a stipulated trigger force is exceeded, for example a trigger force of roughly 600–700 g. The pressure sensor is located on that side of the thumb of the glove with which (side) this thumb bears against the club shaft, so that with a single pressure sensor the force of this thumb and also the force with which the other hand or the inside surface of the hand or the ball of the thumb bears against the thumb of the first hand is monitored. Therefore, the golf glove as claimed in the invention indicates, in the course of a stroke, undesirable clenching of the club and thus enables especially even novice golfers to improve their stroke.

The pressure sensor is made of two pressure point contacts or switches that pass from one state, for example from the opened state, into the other state, for example the closed state, only when the stipulated trigger force is exceeded.

One advantage of the embodiment as claimed in the invention is that clenching of the club by the player is reliably indicated and the player is trained by muscle-remanent training such that the golf club finally lies loosely in the hand for the golf stroke to be correctly executed. The player is therefore guided to a looser swing and to successful golfing.

The electronic circuitry is made for example to deliver an acoustic signal. There can also be a light display or a signal transmitter in the form of a vibrator instead or in addition. In place of an electronic pressure sensor with a signal transmitter, purely mechanical designs are also conceivable. Developments of the invention are the subject matter of the dependent claims.

BRIEF DESCRIPTION OF THE INVENTION

The invention is described in detail below based on the figures and one sample embodiment.

DETAILED DESCRIPTION OF THE INVENTION

Figure 1:
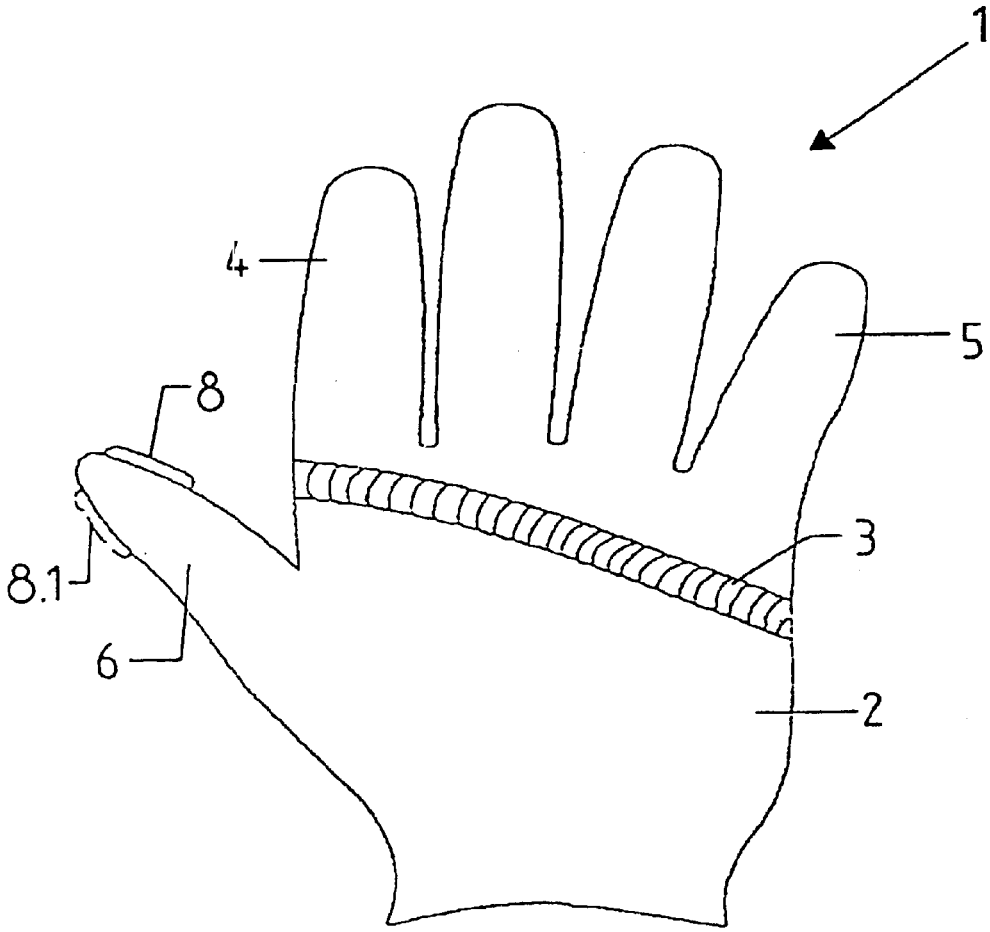
FIG. 1 shows in a simplified representation an overhead view of the inside surface of a golf glove as claimed in the invention for the left hand of a right-hander.
Figure 2:
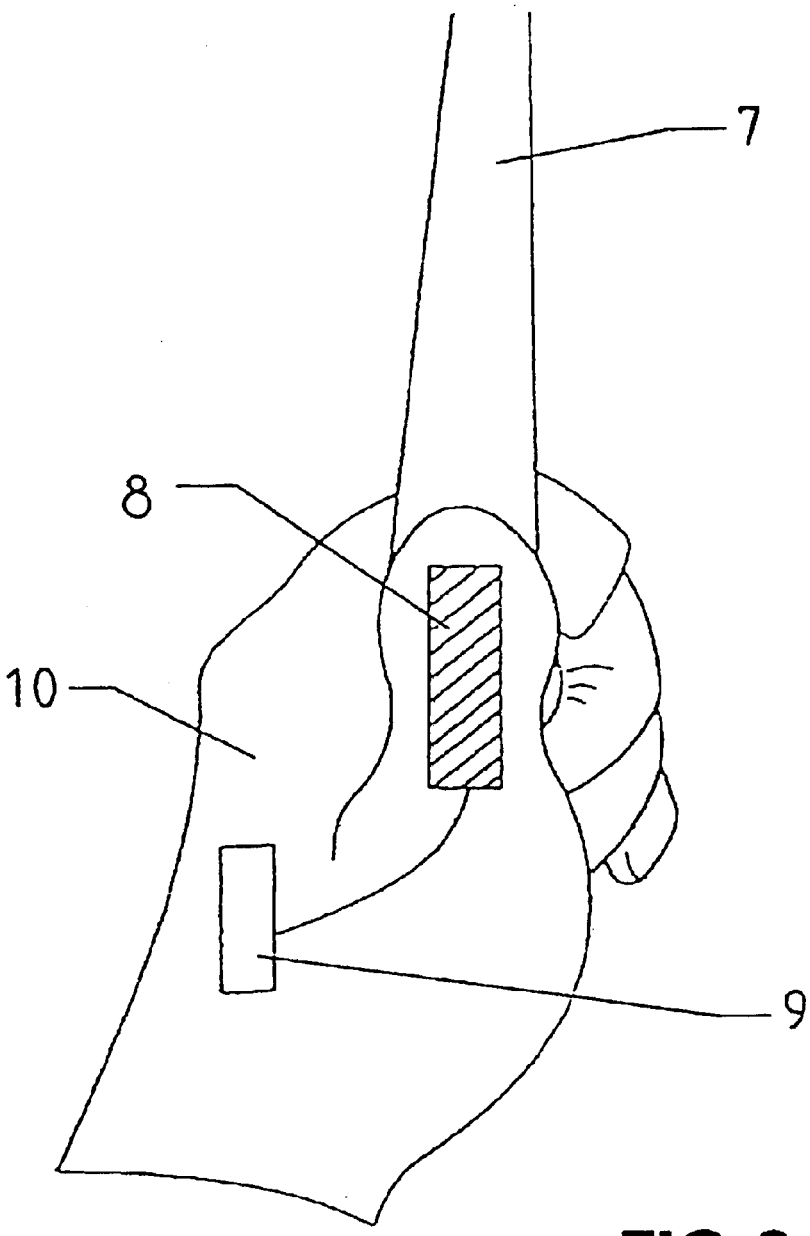
FIG. 2 shows the golf glove of FIG. 1 worn on the left hand of a right-hander, i.e. the hand gripping the shaft of the club.

The golf glove generally designated as 1 in the figures is produced in the conventional manner as a fingered glove from leather or another suitable material and has a bulge-like position aid 3 on the inside surface 2 that projects over this inside surface and that extends from the index finger 4 in the direction of the little finger 5. On the thumb 6 on the inside surface, i.e. on that side that bears directly against the club shaft 7 when the shaft 7 is grasped, there is an electric pressure sensor 8. The latter interacts with electronic circuitry 9 sewn onto the back of the glove 10, in the vicinity of the thumb 6 in the embodiment shown. The pressure sensor 8 is set such that when a predetermined force is exceeded, for example a force of 600–700 g, it is triggered and causes the electronic circuitry 9 to deliver an acoustic signal.

When playing, conventionally the shaft 7 of the golf club is grasped with the left hand, whereby the thumb of this hand and thus the thumb 6 of the golf glove 1 bear against the shaft 7. The right hand likewise bears with the thumb against the thumb of the left hand on the shaft. If the pressure or the force of the right hand exceeds the threshold value (600–700 g) that is stipulated by the pressure sensor 8, an acoustic signal is triggered.

The advantage of using the golf glove 1, therefore, is that when hitting the ball with the club, excess force of the right and left hand is monitored and especially also undue clenching of the club with these hands is indicated. Thus especially novice golfers can practice the optimum stroke with the golf club. The correct location of the club shaft 7 in the hand surface is also guaranteed in any case by the position aid 3 that is provided on the inner surface 2.

Also during execution of the stroke the pressure sensor 8 functions as a monitoring element, i.e. basic errors in the execution of the stroke or vibrations are acoustically indicated.

Figure 3:
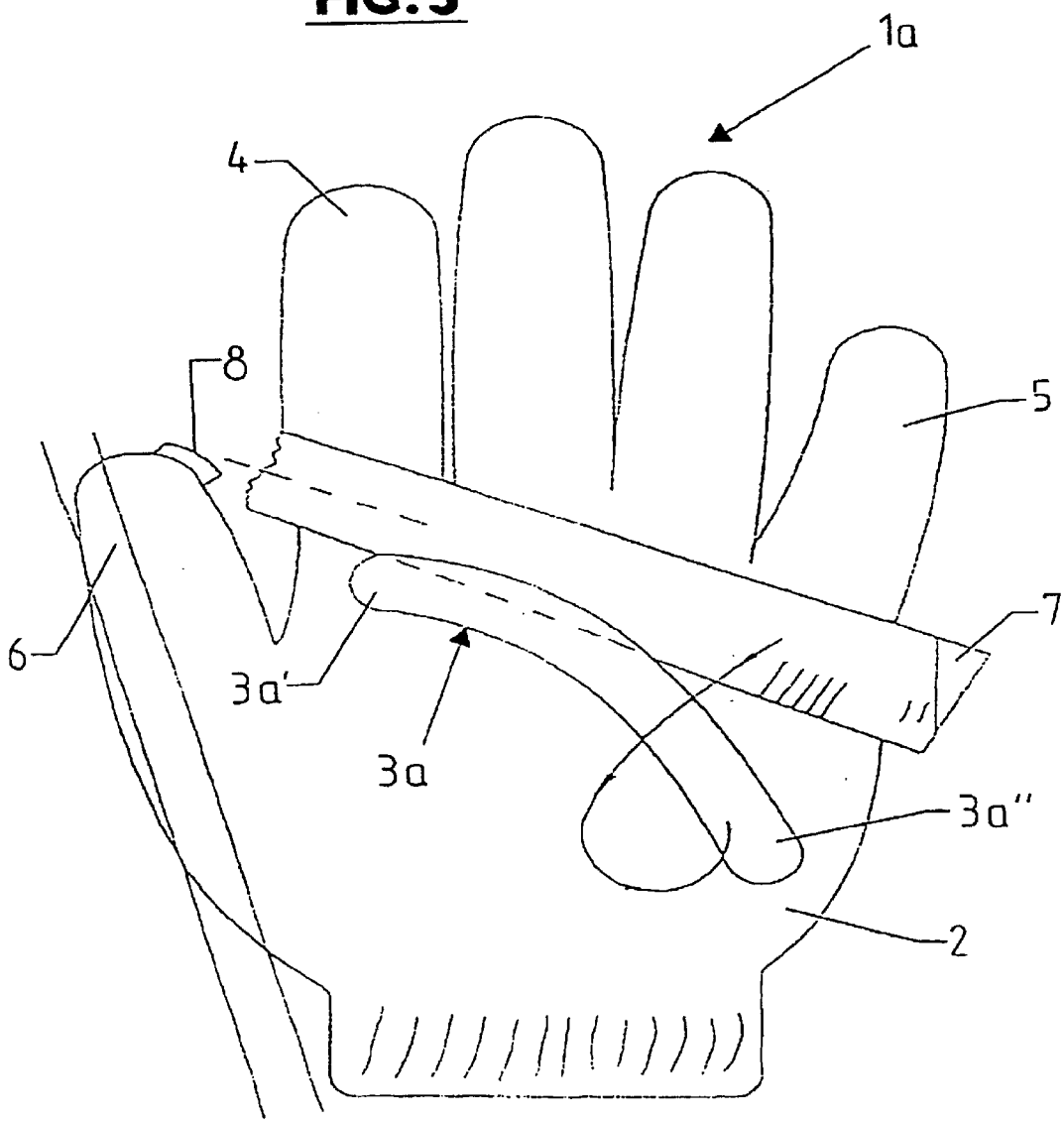
FIG. 3 shows a representation similar to FIG. 1 of another embodiment of the golf glove as claimed in the invention.

FIG. 3 shows in a representation similar to FIG. 1 as another possible embodiment a golf glove 1 a that differs from the glove of FIG. 1 in that instead of the bulge-like position aid 3 that is provided on the inside surface of the glove there is a position aid 3*a* that in turn, beginning in the area on which the index finger 4 of the glove passes into the inside surface of the glove (end 3*a*'), extends as far as the opposite side of the inside surface of the glove (end 3*a*"), the end 3*a*" also having a greater distance from the passage of the little finger 5 to the inside surface 2 of the glove. The position aid 3*a* is curved such that its surface facing the fingers 4 and 5 has a convex profile. The radius of curvature is for example 750 mm.

The special advantage of the position aid 3*a* consists in the fact that with a length proceeding from the end 3*a*' it ensures an aid for the correct positioning of the club shaft 7 or club handle on the golf glove 1*a* or in the hand of the player, especially also correct positioning of the club shaft 7 with reference to the pressure sensor and for this purpose forms a side stop on the concave side against which, with the hand closed, the shaft 7 bears and that in addition with the end 3*a*" it forms a rest for the end of the club shaft or club handle 7 such that this end of the position aid 3*a* provides wear protection that counteracts wearing through of the glove 1*a* on its inside surface 2.

Figure 4:
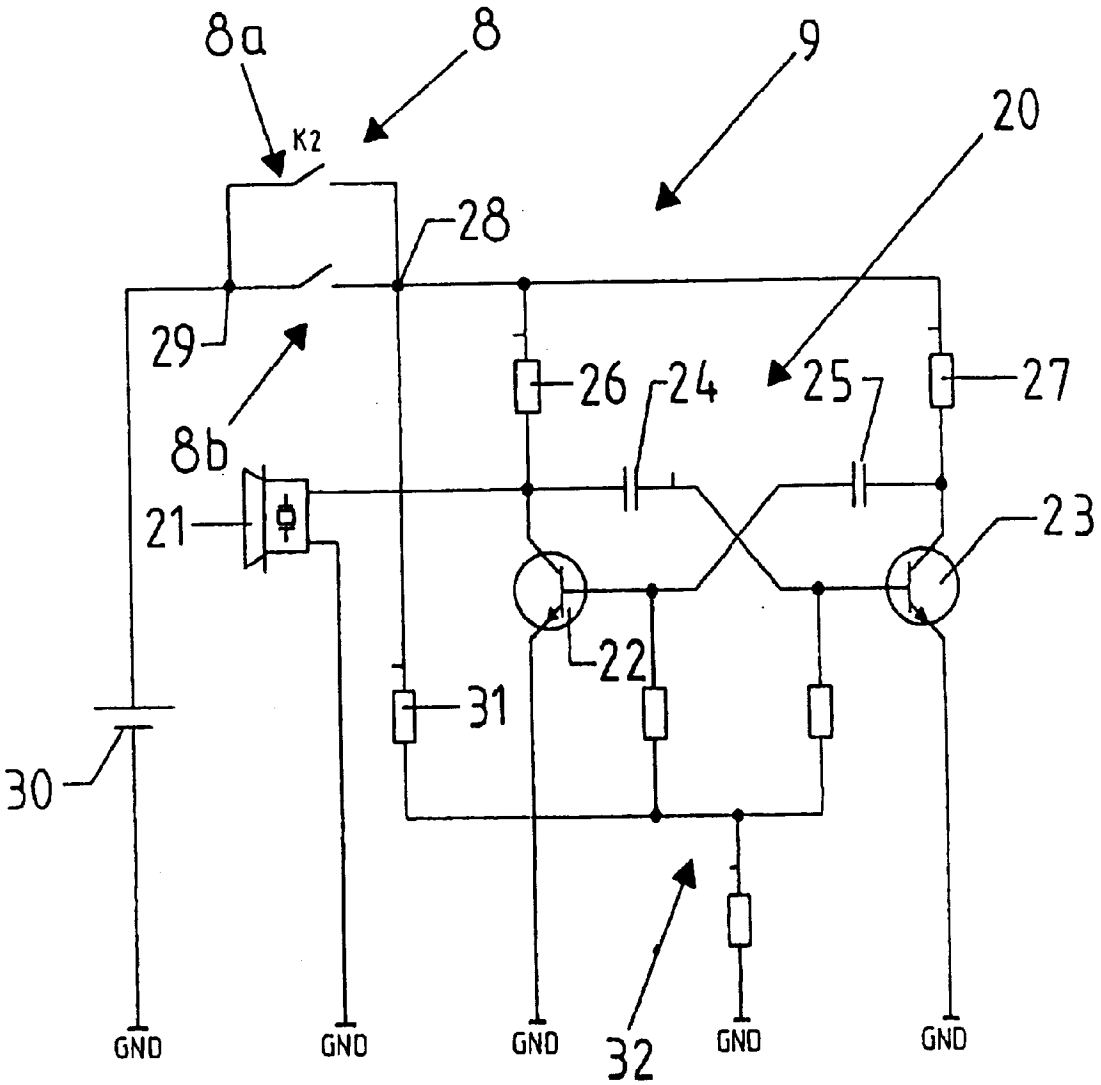
FIG. 4 shows the electronic circuitry of the signal transmitter with the pressure sensor.

FIG. 4 shows the electronic circuitry 9 that is triggered by the pressure sensor 8 and contains the acoustic signal transmitter 21 (piezo buzzer). The circuitry consists essentially of the two transistors 22 and 23, which make up an astable multivibrator 20 and of which each transistor 22 and 23 is connected with its base by means of a coupling capacitor 24 or 25 with the collector of the other transistor 23 or 22. The signal transmitter 21 is located parallel to the collector emitter route of the transistor 22. The collectors of both transistors 22 and 23 are connected by means of their collector resistors 26 and 27 with a connection 28 of the pressure sensor 8, which is connected by means of its other connection 29 with a connection of the battery 30. The connection 30 is furthermore connected by means of a resistor 31 with the resistor network 32, which is located parallel to the base emitter route of the two transistors 22 and 23.

The resistor network 32, the emitters of the two transistors 22 and 23, one connection of the signal transmitter 21 and one connection of the battery 30 are connected with the circuit mass GND.

As FIG. 4 shows, the pressure sensor consists of two pressure switches 8*a* and 8*b* that are located parallel to each other and that change from the opened state to the closed state upon exceeding a stipulated threshold pressure, so that upon closing of only one of the two pressure switches 8*a* and 8*b*, the astable multivibrator 20 is connected with the battery 30 and the signal transmitter 21 is triggered to deliver an acoustic signal.

Figure 5:
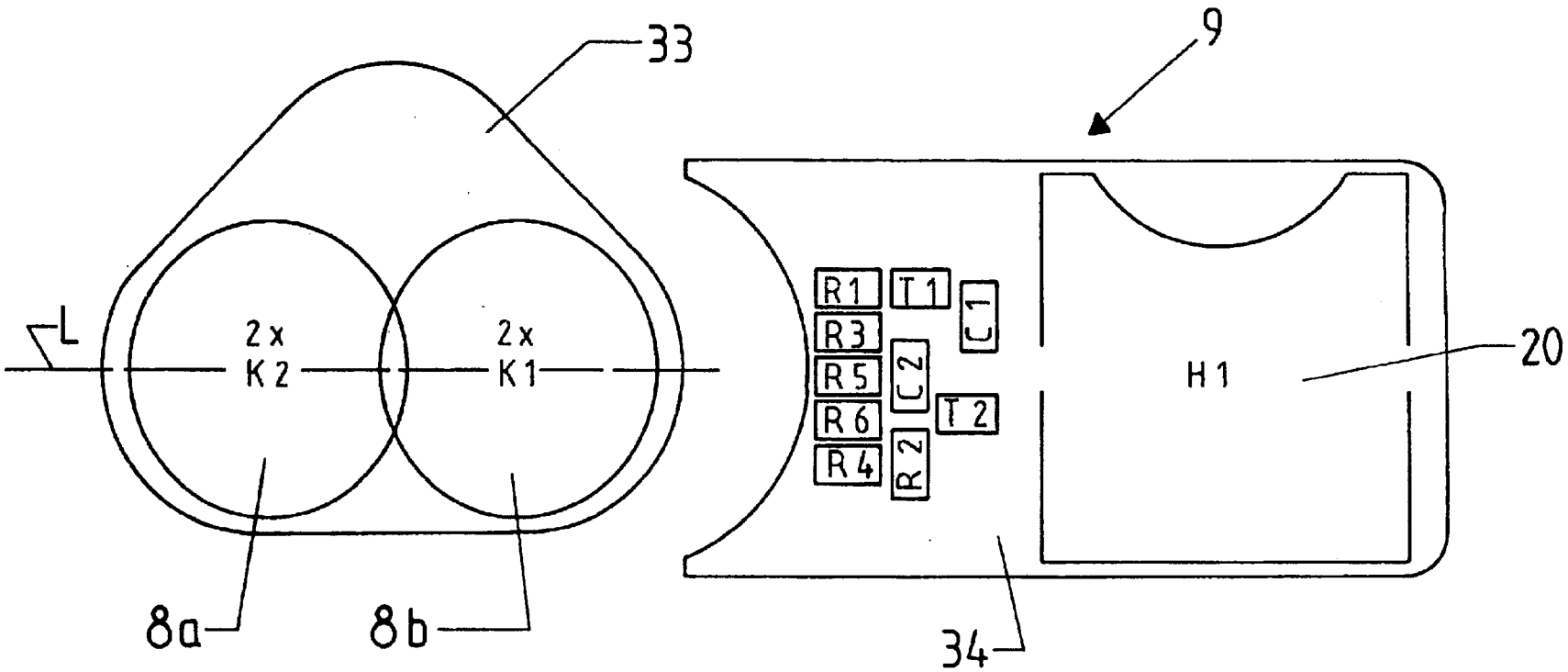
FIG. 5 shows in a simplified representation an overhead view of the pressure sensor and the electronic circuitry.
Figure 6:
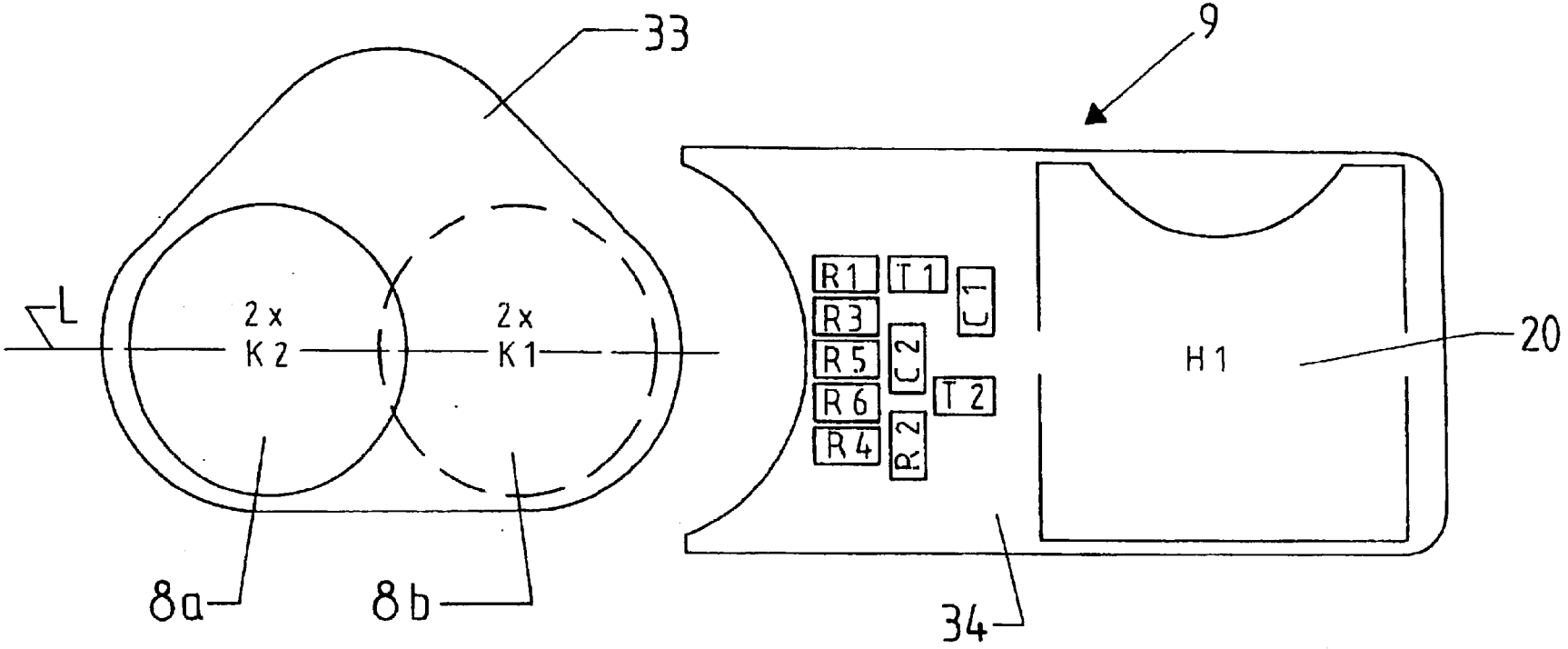
FIG. 6 shows an overhead view of the pressure sensor on opposite sides of the board and the electronic circuitry.

As FIG. 5 shows, the two pressure switches 8*a* and 8*b* are located on a common board or substrate 33 and are made of a highly elastic material, separate from the board or substrate 34 on which the battery 30 and the multivibrator 20 and the signal transmitter 21 are located. As FIG. 5 also shows, the two pressure switches 8*a* and 8*b* are located on the board 33 in a partially overlapping and staggered arrangement in the longitudinal direction of the thumb L, for example on different sides of this board, so as to achieve a relatively large area for the pressure sensor 8. The arrangement of being on different sides of the board is shown in FIG. 6. In this view, pressure switch 8*b*, on the bottom of the board 33 is shown in phantom. The switches are still staggered along the longitudinal axis L of the thumb and overlap one another. The board 33 is sewn onto the thumb and the board 34 is sewn onto the back of the golf glove, both being covered.

The invention was described above based on one sample embodiment. It goes without saying that numerous changes and modifications are possible without departing from the underlying inventive idea of the invention. For example, the golf glove of the left hand for a right-hander, i.e. the glove directly adjoining the club shaft 7 in the case of application, is described above. It goes without saying that for left-handers this glove is one for the right hand.

The embodiment as claimed in the invention also has the advantage that with the two pressure switches 8*a* and 8*b*, both the pressure of the thumb of the left hand and the pressure of the thumb of the right hand can be monitored, since a right-hander, when executing a normal strike with the golf club, places the ball of the thumb of the right hand above the thumb of the left hand. Since the pressure switches 8*a* and 8*b* are staggered in relation to each other in the longitudinal direction of the thumb 6 of the golf glove 1, the pressure switch 8*a*, which is closer to the free end of the thumb 6, monitors the left hand of the player and the other pressure switch 8*b* monitors the right hand of the player. This applies to right-handers. For a left-hander, it is exactly the opposite. In this embodiment, two pressure sensors 8 and 8.1, shown in FIG. 1 can be positioned on opposite sides of the thumb, namely one pressure sensor 8 on the inner side and one pressure sensor 8.1 on the outer side of the thumb.

REFERENCE NUMBER LIST

1 golf glove
2 inside surface of the glove
3 position aid
4 index finger
5 little finger
6 thumb
7 shaft of the club
8 pressure sensor
9 electronic circuitry for producing an acoustic signal
10 back of the glove
11 electric switch or astable multivibrator
12 acoustic signal transmitter
22, 23 transistor
24, 25 coupling capacitor
26, 27 collector resistor
28 switch point
29 switch point
30 battery
31 resistor
32 network
33, 34 board

What is claimed is:

1. A golf glove, consisting essentially of an inner glove surface, a back glove surface, fingers and a thumb, the thumb having an inside and outside surface, a pressure sensor on the thumb, and electronic circuitry connected with the pressure sensor in order to receive a signal from the sensor, wherein the pressure sensor comprises two pressure switches that deliver an acoustic signal when a predetermined trigger force acting on one or both pressure contacts is exceeded, said two pressure switches are positioned in an at least partially overlapping relation to each other on the thumb, and wherein there is a position aid on the inside surface of the glove formed by at least one bulge and provided for a shaft of a club and forms a side support surface for the shaft with one partial length and a rest surface for the shaft with another partial length.

2. The golf glove as claimed in claim 1, wherein said two pressure switches are positioned on opposite sides of a flexible substrate.

3. The golf glove as claimed in claim 1, wherein the two pressure switches are staggered in relation to each other in the longitudinal direction of the thumb.

4. The golf glove as claimed in claim 1, wherein the electronic circuitry is an astable multivibrator with an acoustic signal transmitter triggered by the multivibrator.

5. The golf glove as claimed in claim 1, wherein said multivibrator is a piezo buzzer.

6. The golf glove as claimed in claim 1, wherein the pressure sensor is provided on the free end of the thumb.

7. The golf glove as claimed in claim 1, wherein the electronic circuitry is made for delivering at least one of an acoustic signal, visual signal or a signal in the form of a mechanical vibration when the trigger force is exceeded.

8. The golf glove as claimed in claim 1, wherein the trigger force is in the range between roughly 600–700 g.

9. The golf glove as claimed in claim 1, wherein the glove is for the left hand.

10. The golf glove as claimed in claim 1, wherein the glove is for the right hand.

11. A golf glove, consisting essentially of an inner glove surface, a back glove surface, fingers and a thumb, the thumb having an inside and outside surface, a pressure sensor on the inside or outside surface of the thumb, and electronic circuitry connected with the pressure sensor to receive a signal from the sensor, the pressure sensor comprises two pressure switches that deliver an acoustic signal when a predetermined trigger force acting on one or both pressure contacts is exceeded, wherein said two pressure switches are positioned in an overlapping relation to each other on opposite sides of the thumb, namely one pressure switch on the inner side and one pressure switch on the outer side of the thumb, and wherein on the inside surface of the glove there is a position aid that is formed by at least one bulge and that is provided for a shaft of a club and forms a side support surface for the shaft with one partial length and a rest surface for the shaft with another partial length.

* * * * *